US006595607B2

(12) United States Patent
Morgan

(10) Patent No.: US 6,595,607 B2
(45) Date of Patent: Jul. 22, 2003

(54) COUNTER TOP APPLIANCE STAND

(76) Inventor: Fletcher Morgan, 4990 Coquina Key Dr. SE., St. Petersburg, FL (US) 33705

( * ) Notice: Subject to any disclaimer, the term of this patent is extended or adjusted under 35 U.S.C. 154(b) by 15 days.

(21) Appl. No.: 09/804,306

(22) Filed: Mar. 13, 2001

(65) Prior Publication Data

US 2002/0024275 A1 Feb. 28, 2002

Related U.S. Application Data

(63) Continuation-in-part of application No. 29/128,582, filed on Aug. 29, 2000, now Pat. No. Des. 444,996.

(51) Int. Cl.[7] ..... A47B 97/00; A47B 88/00

(52) U.S. Cl. ..... 312/294; 312/330.1; 312/348.1; 312/348.6

(58) Field of Search ..... 312/294, 330.1, 312/334.1, 334.6, 324.27, 348.1, 348.2, 348.4, 348.6, 902, 7.2, 140.4, 258, 261, 283, 317.1

(56) References Cited

U.S. PATENT DOCUMENTS

| | | | | | |
|---|---|---|---|---|---|
| 2,613,623 | A | * | 10/1952 | Behrens | 109/59 R |
| 3,003,839 | A | * | 10/1961 | Bloom et al. | 312/330.1 X |
| 3,098,686 | A | * | 7/1963 | Benoit | 312/348.6 |
| 3,730,604 | A | * | 5/1973 | Viera | 312/330.1 X |
| 4,090,756 | A | * | 5/1978 | Frey et al. | 312/330.1 X |
| 4,944,402 | A | * | 7/1990 | Wu | 312/108 X |
| 5,058,849 | A | * | 10/1991 | Harvey, Sr. | 248/442.2 |
| 5,114,007 | A | * | 5/1992 | Chen | 312/902 X |
| 5,147,120 | A | * | 9/1992 | Ray | 312/111 |
| 5,433,518 | A | * | 7/1995 | Skov | 312/348.1 |
| 5,466,058 | A | * | 11/1995 | Chan | 312/111 |
| 5,588,727 | A | * | 12/1996 | D'Agaro et al. | 312/283 |
| 5,692,815 | A | * | 12/1997 | Murphy | 312/283 |
| 5,729,430 | A | * | 3/1998 | Johnson | 312/208.3 X |
| 5,738,423 | A | * | 4/1998 | Alfaro | 312/330.1 X |
| 5,944,596 | A | * | 8/1999 | Hargrove | 452/105 |

FOREIGN PATENT DOCUMENTS

| | | | | |
|---|---|---|---|---|
| CH | 658171 | * | 10/1986 | 312/348.1 |
| IT | 637375 | * | 3/1962 | 312/348.6 |

* cited by examiner

*Primary Examiner*—James O. Hansen
(74) *Attorney, Agent, or Firm*—John S. Hale; Gripple & Hale

(57) ABSTRACT

An appliance stand for storing utensils comprising an enclosed housing with an integral front wall, side walls connected to the front wall, a rear wall connected to the side walls and a planar top member secured to the walls defines an interior chamber. All of the walls are angled inward and the front wall defines a rectangular cutout leading into the chamber for receiving a drawer. The drawer is slidably mounted in the housing. The drawer is constructed of a one piece assembly comprising a base, a front panel, side panels and a rear panel mounted on the base with the panels being foldable with respect to the base with the front panel fitting flush against the housing front wall rectangular cutout.

16 Claims, 9 Drawing Sheets

COUNTER TOP APPLIANCE STAND

CROSS-REFERENCE TO RELATED APPLICATIONS

This a continuation-in-part application of U.S. Design patent application Ser. No. 29/128,582 filed Aug. 29, 2000 now U.S. Design Pat. No. D,444,996.

TECHNICAL FIELD OF THE INVENTION

The present invention generally relates to an appliance stand and more specifically is directed toward an integrally molded appliance stand with a housing having a flat upper surface bounded by a raised rim and a foldable hinged drawer slidably mounted in the housing. The drawer is used for storage of utensils commonly used and associated with counter top appliances such as splatter screens, eating and serving utensils, insulated gloves and the like.

BACKGROUND OF THE PRIOR ART

An appliance stand is useful for holding appliances such as microwaves, crock pots, slow cookers, grills and other insulated cooking devices. In the prior art shaped wire stands have been used to elevate the appliance or to provide open storage for related use utensils, splatter screens and similar items. One form of commonly used stand is a ceramic or marble/granite planar base mounted on a wire housing such as is seen in U.S. Pat. No. 2,679,736 or a tray as seen in U.S. Design Pat. No. 399,702. Another commonly used type of stand is a wire rack with legs and supports such as that shown in U.S. Pat. Nos. 2,190,065, 3,013,670 and 4,943,029. Another patent of interest is U.S. Design Pat. No. 327,200 which discloses a solid tray with a flat upper surface and a slidable extension drawer.

Accordingly, the novel appliance stand has been developed to hold microwaves, cookers and other appliances which resolves the problems of counter space, provides storage, hides auxiliary utensils from sight, while providing protection of utensils from grease, dust and the like as well as being easily cleaned or placeable in a dishwasher for cleaning.

SUMMARY OF THE INVENTION

The present invention is directed toward a plastic appliance stand with an integrally molding housing having an upper flat surface to support and elevate the appliance and a slidable drawer slidably mounted within the housing to hold and protect utensils, splatter screens and other items from exposure to the normal kitchen debris such as grease, dirt, spillage and the like. The slidable drawer has foldable panels which are secured to adjacent panels and a recessed handle formed in the front panel which allows easy grasping to pull or push the drawer while eliminating accidental contact. As normal doors of counter top appliances are side-hinged and therefore swing open from side to side generally leaving less than ¾ inch clearance above the counter top, it is difficult to place any object in front of the appliance door without having to remove the same to open the appliance door. It is usual and common to stir food in those appliances during cooking and therefore any stirring device must be moved to enable the user to open the door to do so. This means that an additional 16 to 18 inches of counter space is needed when using those appliances to allow for the opening and closing of the appliance door.

It is an object of the invention to provide an appliance stand equipped with an enclosed slidable drawer for storage of "splatter screens" or other covers used to prevent food from "splattering" the inside of a counter top appliance during cooking.

It is another object of the invention to provide an appliance stand with a slidable drawer which fits flush against the front wall of appliance stand to eliminate spillage into the interior of the drawer and prevent snagging of clothing on the handle or engagement of the handle with utensils.

It is yet another object of the invention to provide an appliance stand which can be easily assembled without tools.

It is another object of the invention to elevate the appliance and the cooking surface of the same to provide more convenient viewing of the food being cooked in the appliance.

It is yet another object of the invention to provide an appliance stand having a flat top surface which is suitable for holding the majority of counter top appliances being used.

It is still another object of the invention to provide an appliance stand with a flat top surface surrounded by an upright rib to prevent the appliance from sliding or being knocked off of the flat surface of the appliance top.

It is yet another object of the invention to provide the user with storage space in the appliance stand for any utensils being used allowing easy access of same for use during cooking as well as reduce the amount of counter space needed for use of such a counter top appliance and accessories.

It is still another object of the invention to provide for an easily accessible storage space next to the appliance which protects utensils and other related cooking devices from grease or dirt during the cooking process as well as after the cooking process is finished.

It is still another object of the invention to provide an appliance stand with a smooth outer surface allowing easy cleaning of the stand.

In the accompanying drawings, there is shown illustrative embodiments of the invention from which these and other objectives, novel features and advantages will be readily apparent.

DETAILED DESCRIPTION OF THE INVENTION

Figure 1:
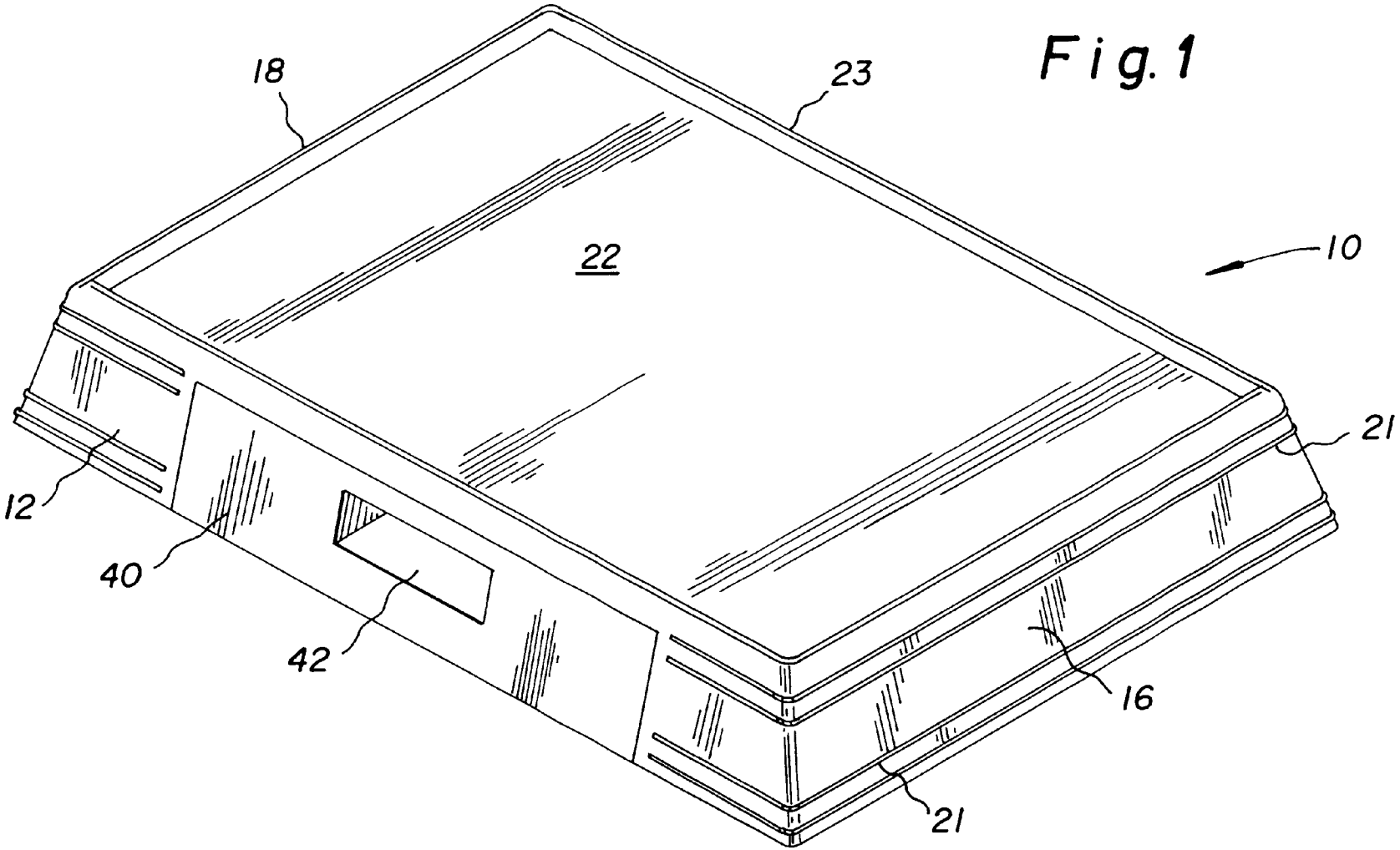
FIG. 1 is a perspective view of the appliance stand with the drawer closed.
Figure 2:
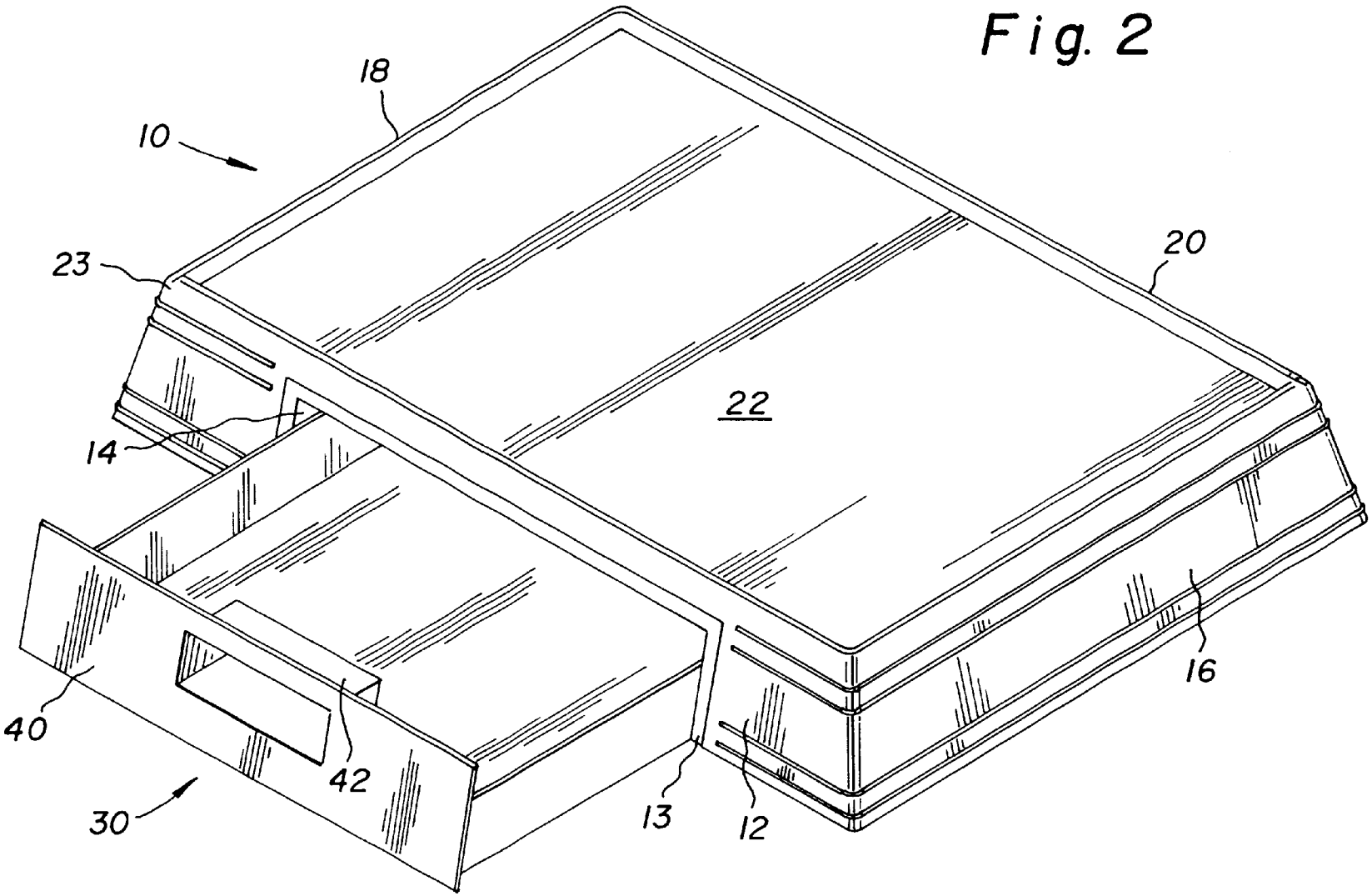
FIG. 2 is a perspective view of the appliance stand of FIG. 1 with the drawer opened.
Figure 3:
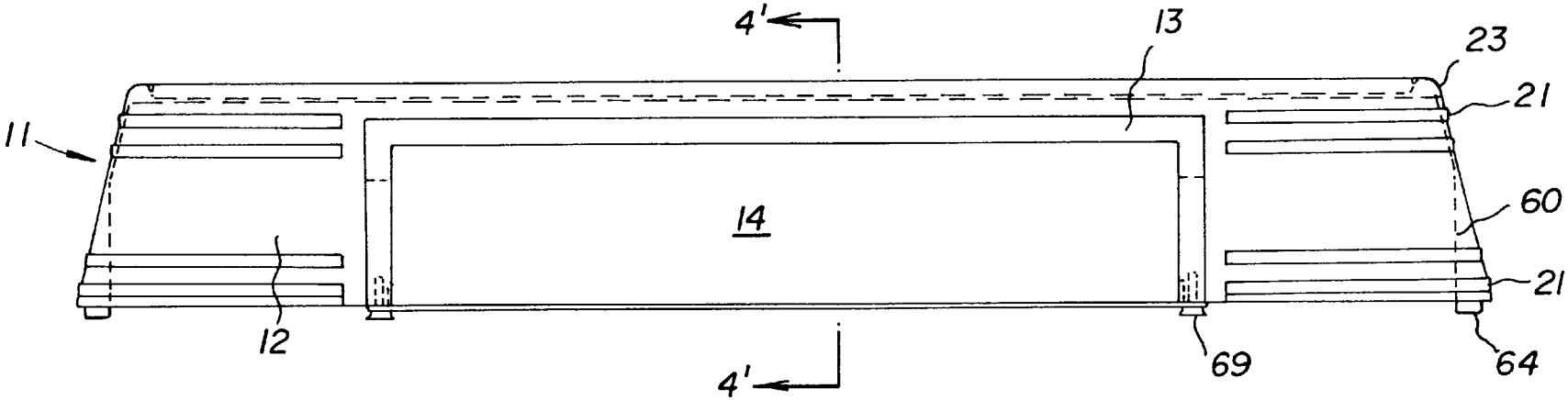
FIG. 3 is a front elevational view of the appliance stand of FIG. 1 with drawer removed.
Figure 4:
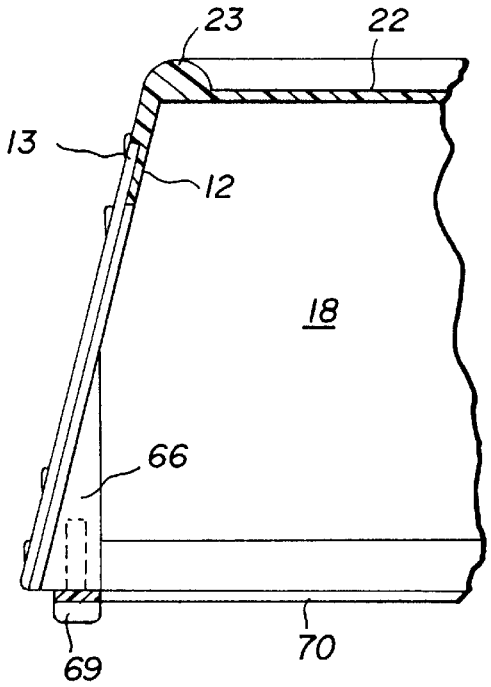
FIG. 4 is an enlarged partial cross sectional view of the appliance stand of FIG. 3 taken along line 4'—4'.

The preferred embodiment and best mode of the appliance stand invention is shown in FIGS. 1–13. The component material used for the appliance stand 10 is an ABS plastic which is easily cleaned and provides the strength for supporting an appliance seated thereon. However any other plastic can be use which has similar strength and physical characteristics.

The appliance stand 10 as shown in FIGS. 1–13 is an integrally molded plastic housing 11 having a truncated pyramidal form with the walls being inclined from 10° to 20° from vertical, the preferred angle being 14° from vertical. The housing 11 is constructed with a front wall 12 defining a drawer aperture 14, integral side walls 16 and 18 and rear wall 20. A planar top member 22 is surrounded by and is defined by a rounded upright rib or ridge 23 positioned above the tops of walls 12, 16, 18 and 20 surrounding the outer surface of top member 22. A plurality of parallel ribs 21 extend around the upper and lower outer wall surfaces of the housing.

Figure 6:
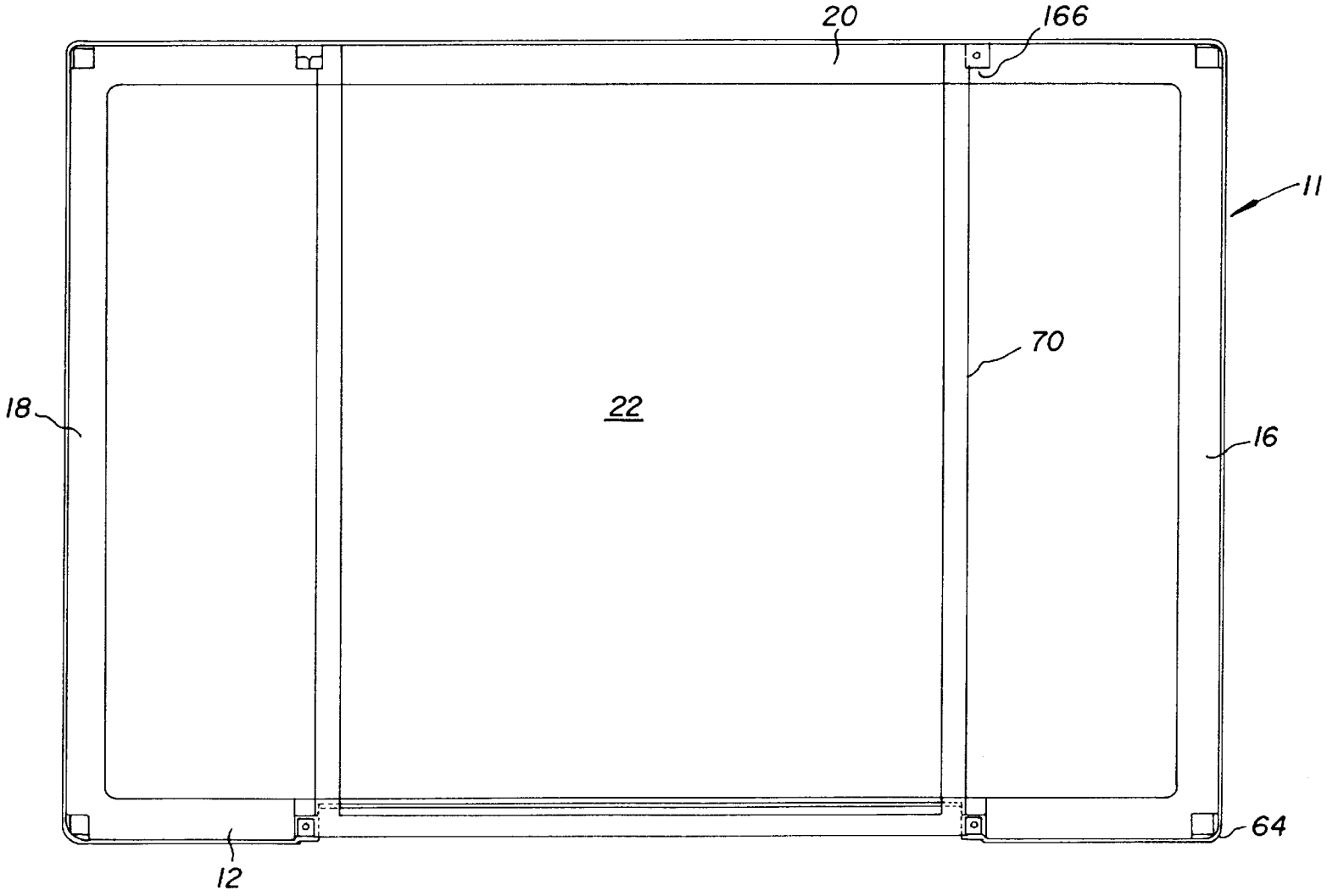
FIG. 6 is a bottom plan view of the appliance stand shown in FIG. 5.
Figure 8:
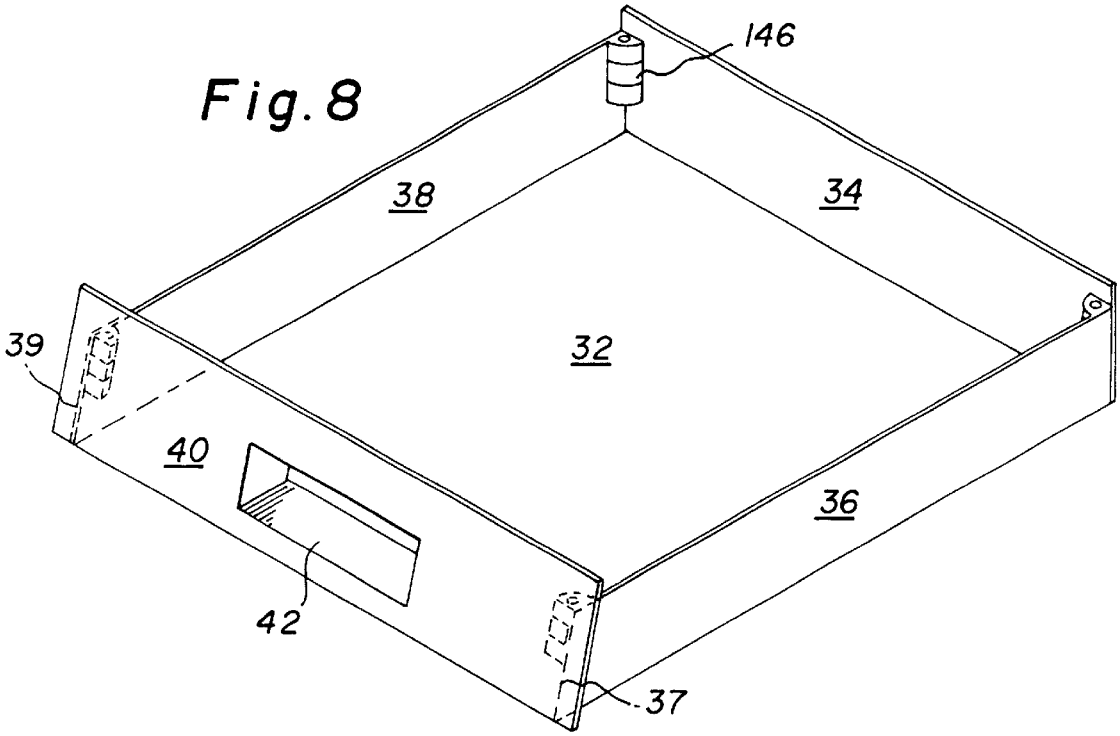
FIG. 8 is an enlarged perspective view of the drawer of FIG. 2 removed from the appliance stand with hinges and side walls shown in phantom.
Figure 9:
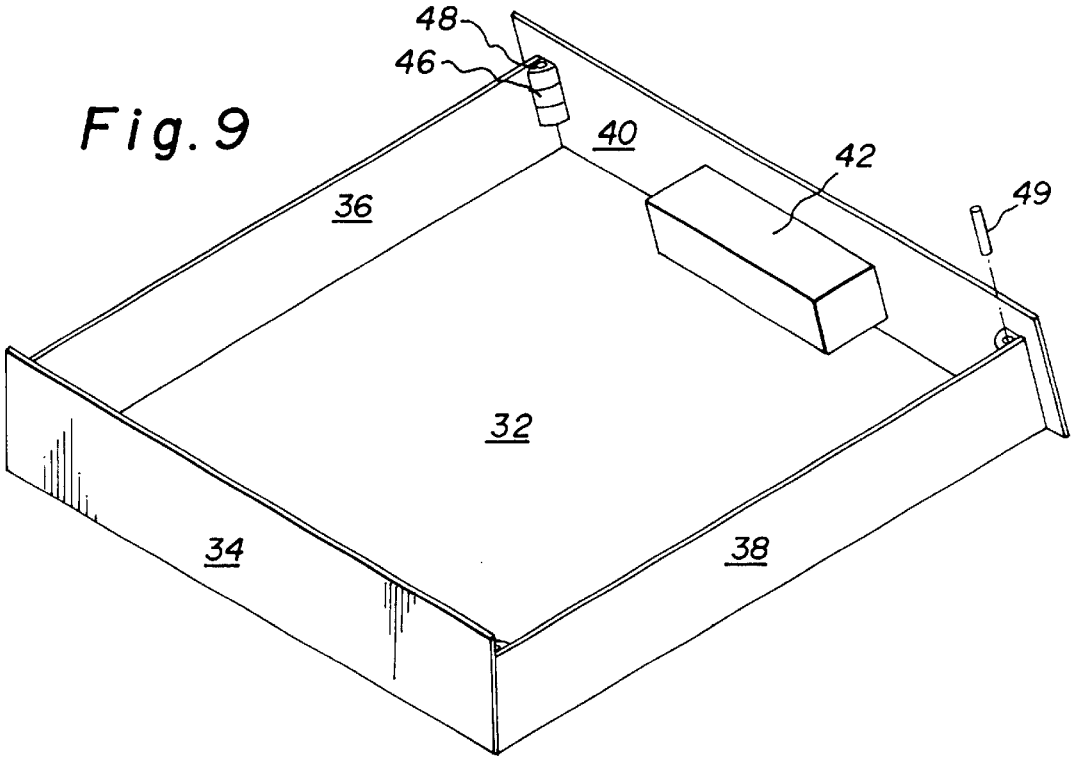
FIG. 9 is a reverse perspective view of the drawer of FIG. 8 with an exploded view of the hinge pin.
Figure 10:
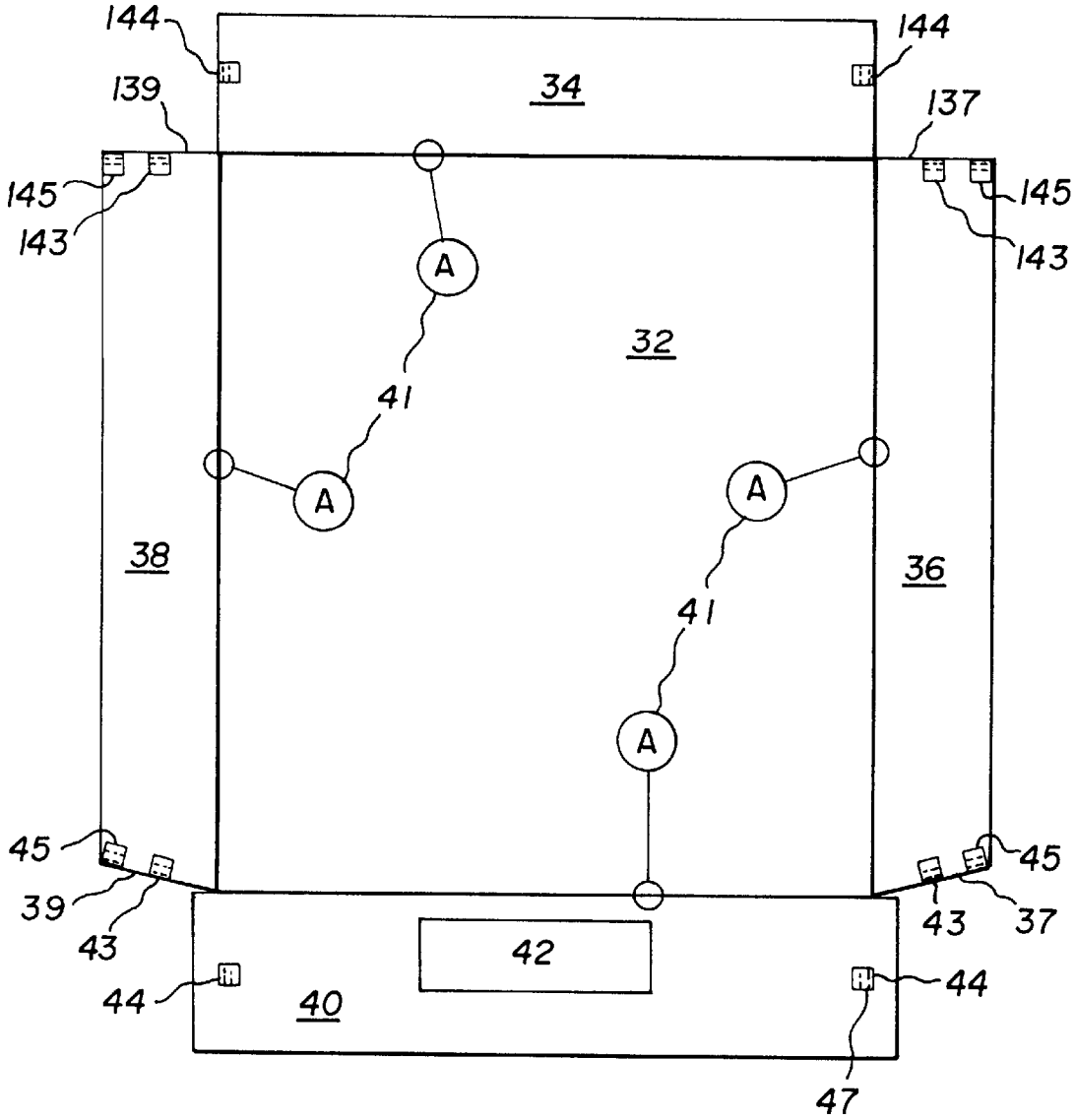
FIG. 10 is a top plan view of the drawer shown in FIGS. 8 and 9 showing the respective foldable panel wall relationships with the corner hinges broken apart.
Figure 11:
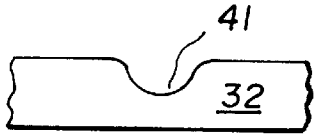
FIG. 11 is an enlarged cross sectional view of the panel base fold interface shown in circles A on FIG. 10.
Figure 12:
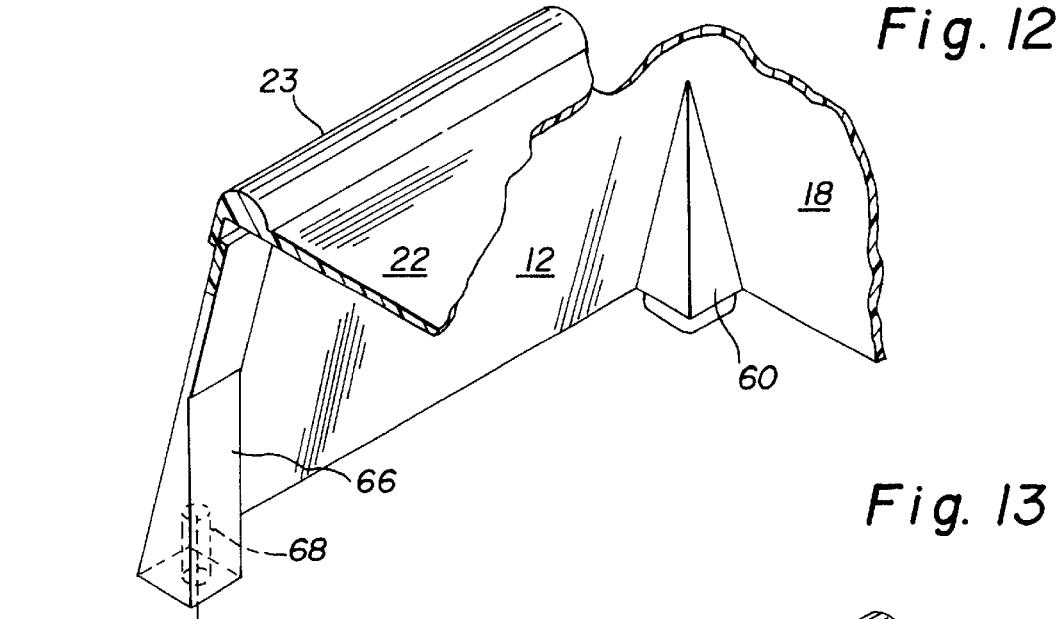
FIG. 12 is an exploded enlarged cross sectional view partially in perspective of the drawer slide supports of the inventive appliance stand with a blind pin bore shown in phantom.
Figure 13:
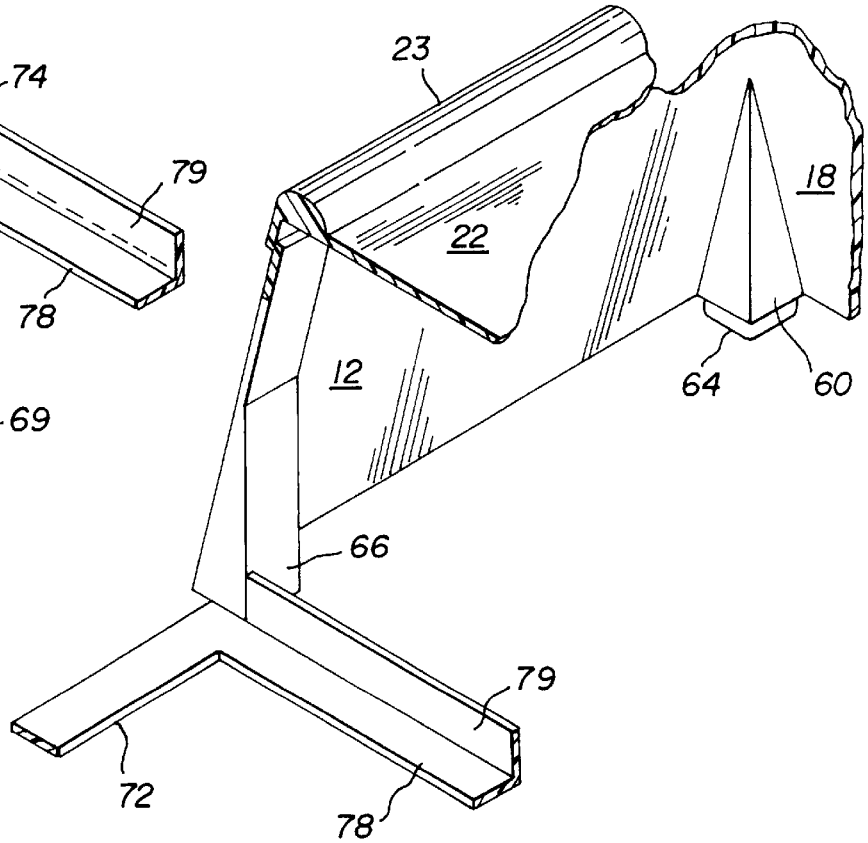
FIG. 13 is an assembled cross sectional view partially in perspective of the drawer slide supports of FIG. 12.

A foldable panel drawer assembly 30 is slidably mounted on a drawer slide and support member 70 mounted to the bottom of housing 11 as best seen in FIGS. 6 and 13. The drawer slide and support member 70 is mounted to the bottom wall edges of the housing 11 as is seen in FIGS. 6, 12 and 13. The drawer assembly 30 is substantially rectangular in configuration when assembled with an inclined front panel 40 and as seen in FIGS. 8–11 is constructed with a base panel 32 which is integrally connected to foldable rear panel 34, foldable side panels 36 and 38 and foldable front panel 40. As can be seen in FIGS. 10 and 11, a panel fold channel 41 is cut or molded between the boundaries of the base panel 32 and the respective front, rear and side panels (40, 34, 36 and 38) allowing the same to be folded angularly upward along the fold line or channel 41. The fold channel 41 is cut into the plastic sheet about 0.06 inches wide and about 0.03 inches deep allowing the panels to be folded into a transverse relationship with the respective hinge sections on adjacent panels aligning when fully folded. The front panel 40 is formed with a recessed handle 42 located in the middle and center of the panel and hinge bosses 44 are molded on each end of the front panel 40. These hinge bosses are formed with a through going bore 47 and when front panel 40 is placed against the inclined front surfaces 37 and 39 of the side panels 36 and 38, the two separated hinge bosses 43 and 45 of the side panels 36 and 38 and their respective bores are aligned with front panel boss 44 to form a hinge assembly 46 (bosses 43, 44 and 45) on either side of the front panel 40. The hinge assembly 46 defines a single through going bore 48 which receives and holds hinge pin 49 securing the respective adjacent panels together. The rear end surfaces 137 and 139 of side panels 36 and 38 are perpendicular and are provided with identical spaced hinge bosses 143 and 145 which align with hinge bosses 144 positioned on each end of rear panel 34 to form hinge assembly 146. All of the hinge assemblies 46 and 146 are held together with hinge pins 49.

Figure 7:
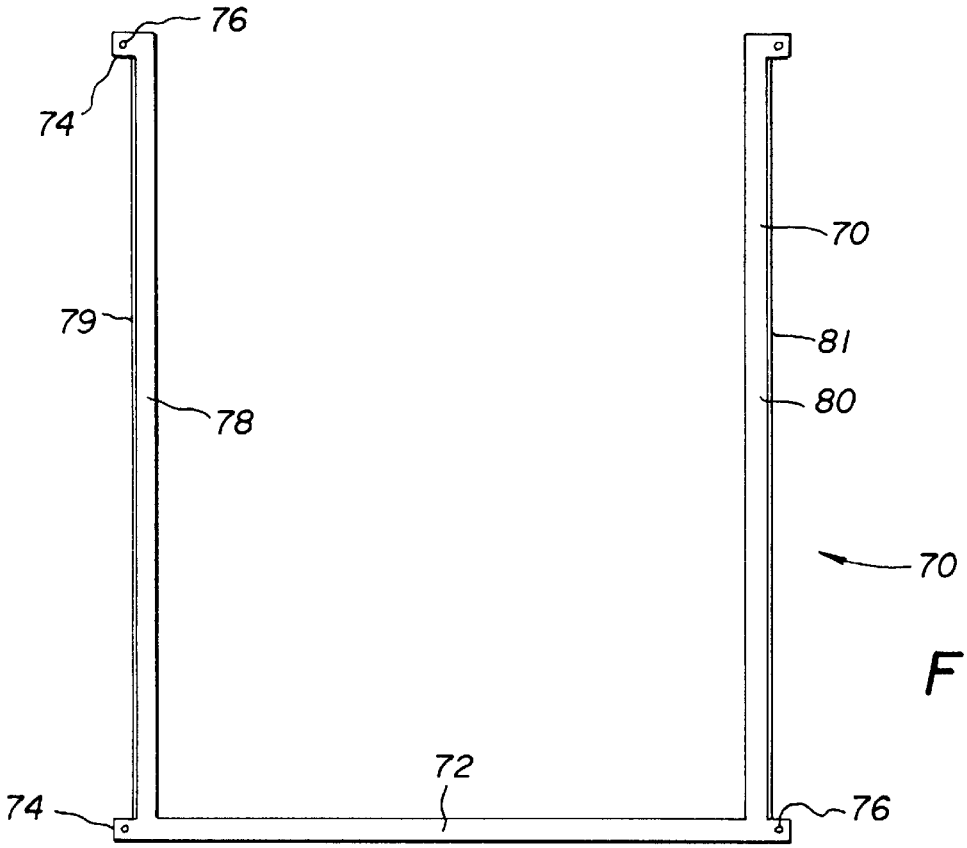
FIG. 7 is a top plan view of the drawer slide support member.
Figure 5:
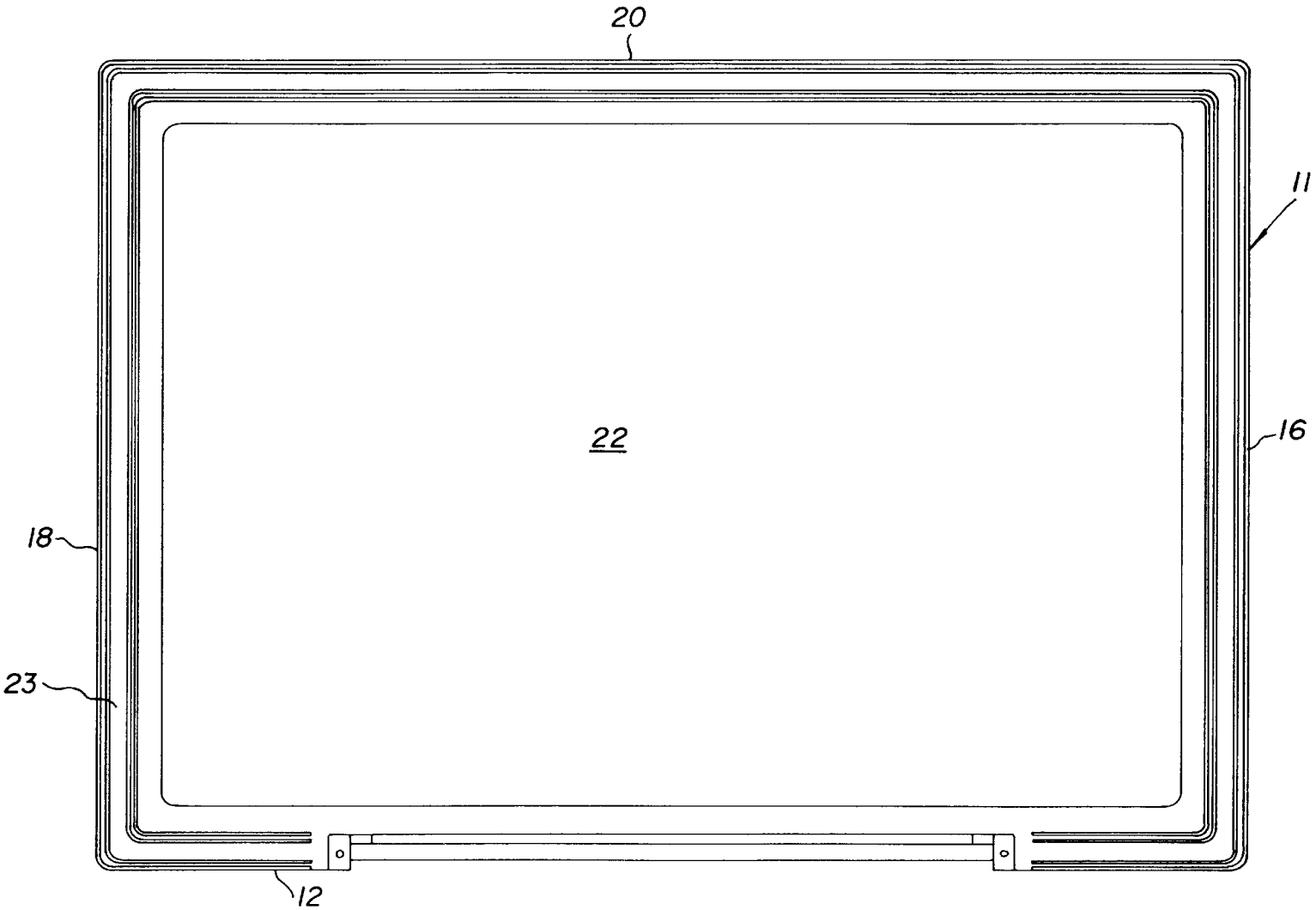
FIG. 5 is an enlarged top plan view of the appliance stand shown in FIG. 1 with drawer removed.

Each of the corners of the appliance housing 11 has a triangular shaped boss 60 integrally formed therein to provide structural support and define a blind bore 62 cut or molded therein to receive a pin foot member 64 so that the housing 11 and drawer 30 are elevated from the seating surface. The front wall 12 of the housing is formed with a triangular shaped boss 66 located on each side of the drawer opening 42 with a blind bore 68 cut therein to receive fastening pins 69 holding the front of the drawer slide assembly 70. Bosses 166 (not shown) are formed on the rear wall 20 to receive fastener pins 69 securing the rear or legs 78 and 80 of the drawer slide assembly. The drawer slide assembly 70 as seen in FIG. 7 is formed in a rectangular U shape with slide base cross member 72 provided with extending ears 74 extending outward from the ends of the base 72 and legs 78 and 80 which also have extending ears 74. The ears 74 define through going holes 76 which are aligned with blind bores 68 of bosses 66 and 166 formed in the housing 11 and receive the fastening pins 69 which are interference fit holding the drawer slide assembly 70 in place on the bottom of the housing. Side legs 78 and 80 are also provided with integrally formed upright guide rails 79 and 81 transverse to the plane of the side legs and the guide rails extend upward from the outer end surface of the side legs 78 and 80 guiding the drawer 30 on the side legs.

In assembling the appliance stand, the slide assembly 70 is aligned so that the ears 74 and their corresponding holes 76 are aligned with the housing boss bores 68 located on the bottom of the front wall 12 and rear wall 20 and fastening pins 69 are interference fit into the bores holding the slide assembly in a fixed position to the housing 11. Foot pins 64 are then inserted into the blind bores of the corner bosses 60.

In order to assemble the drawer 30 from its one piece molded form as shown in FIG. 10, the rear panel 34 is folded upward along fold line 41 and the side panels 36 and 38 are also folded upward along fold line 41 until hinge sections 143, 144, and 145 and the through going bores for the hinge sections are aligned with a hinge pin 49 being inserted through the through going bore in the hinge section holding the same together. Front panel 40 is folded along fold line 41 until it abuts the angled ends 37 and 39 of side panels 36 and 38 forming an inclined angle which is the same as the angle of the front wall 12 of housing 11. Hinge sections 43, 44, and 45 of the adjacent panels are aligned and a hinge pin 49 is inserted through the through going bore in the hinge section holding the same together. As noted the front panel 40 is angled rearward the same degree of incline (10° to 20° preferably 14°) as the front wall 12 of the housing 11 and fits within the step recess 13 cut or molded around the edge of the drawer opening 14 so that the outer surface of the front panel 40 is flush with the outer surface of the front wall 12. The step recess 13 also acts as a stop for the drawer 30.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present inventions defined by the following claims.

What is claimed is:

1. An appliance stand comprising an enclosed housing with a front wall, side walls connected to said front wall, a rear wall connected to said side walls and a planar top member secured to said walls; said walls and top member defining an interior chamber, said front wall defining a recessed cut out opening leading into said interior chamber, said recessed cutout forming a stepped seat to receive a front panel of a drawer so that said drawer front panel is flush with an outer surface of said front wall;

said housing side walls and front and rear walls defining a plurality of corner areas with a mounting boss formed therein, each said mounting boss defining a bore adapted to receive a pin;

a drawer support member mounted to said housing, a drawer slidably mounted in said housing chamber on said drawer support member; said drawer comprising a base, a front panel, side panels and a rear panel connected to said base, with said front panel fitting against said housing front wall;

said drawer side panels being inclined at one end to abut said drawer front panel and are secured to said front panel, said drawer front panel forming a plane orientated at the same angle as the orientation of a plane of said front wall of said housing.

2. An appliance stand as claimed in claim 1 wherein all of said housing walls are angled toward said top member to provide inclined outer surfaces forming a truncated pyramid configuration.

3. An appliance stand as claimed in claim 1 wherein said drawer front panel has a recessed handle in the form of a closed rectangular recess extending rearward from said front panel into said drawer.

4. An appliance stand as claimed in claim 1 including drawer slide seating bosses located on each side of said front wall drawer cut out and on said rear wall, said bosses extending into said housing chamber, each slide seating boss defining a blind bore therein adapted to receive fastening means.

5. An appliance stand as claimed in claim 1 wherein said drawer front panel and said drawer rear panel have a hinge portion formed therein which align with hinge portions on a respective adjacent side panel to form a fastening hinge.

6. An appliance stand as claimed in claim 1 wherein said drawer panels and base are integrally formed but spaced from said base by a groove allowing each drawer panel to be folded at an angle with respect to said base.

7. An appliance stand as claimed in claim 1 wherein said top member of said housing has an inner planar surface surrounded by a rib which extends upward from a plane of said planar surface.

8. An appliance stand as claimed in claim 1 wherein said housing walls and said drawer panels are constructed of plastic.

9. An appliance stand as claimed in claim 8 wherein said plastic is ABS.

10. An appliance stand comprising an integrally formed plastic housing with a front wall, side walls connected to said front wall, a rear wall connected to said side walls and a planar top member secured to each of said walls, all of said housing walls being angled toward said planar top member to provide inclined side surfaces angled inward 10° to 20° from vertical, said walls and top member defining an interior chamber, said front wall defining a rectangular cutout with a stepped seat leading into said chamber allowing a front panel of a drawer to be seated therein so that an outer surface of the front panel and an outer surface of said front wall are flush;

a drawer slide support member mounted to said housing;

a drawer slidably mounted in said housing chamber on said drawer slide member, said drawer comprising an integrally formed assembly comprising a base, a front panel which defines a recessed handle, side panels and a rear panel formed with and connected to said base but defined from said base by a fold groove allowing said panels to be folded at an angle to a plane of said base, said front and rear panels having hinge means which mate with hinge means formed on the inner end surface of the side panels allowing the side panels to be fastened to the front and rear panels.

11. An appliance stand as claimed in claim 10 wherein said groove has a diameter which is about twice its depth.

12. An appliance stand as claimed in claim 10 wherein said drawer side panels are inclined at one end with said front panel being secured thereto to form a plane which is at the same angle as the plane of said front wall of said housing.

13. An appliance stand as claimed in claim 10 wherein said housing walls and said drawer panels are constructed of ABS plastic.

14. An appliance stand comprising a plastic housing with inclined walls including front wall, side walls connected to said front wall, a rear wall connected to said side walls and a planar top member having an upright rib extending around its outer perimeter secured to each of said walls; said walls and top member defining an interior bottomless chamber, all of said housing walls are angled toward said planar top member to provide inclined side surfaces angled about 10° to about 20° from vertical, said front wall defining a rectangular cutout leading into said chamber and a stepped recess on the outer surface around said cutout to receive a drawer front panel so that said drawer front panel is flush with an outer surface of said front wall;

a drawer slide support member mounted to said housing;

a one piece foldable plastic drawer slidably mounted in said housing chamber on said drawer slide support member, said drawer comprising an integrally formed assembly comprising a base, an angled front panel orientated at the same angle as said housing front wall, side panels and a rear panel formed with and connected to said base but defined from said base by a fold groove allowing said panels to be folded at an angle to a plane of said base, said side walls being angled at one end adjacent said front panel, said front and rear panels being provided with hinge means which mate with hinge means formed on the inner end surface of the side panels allowing the same to be fastened together said front panel when seated in said front wall cut out stepped recess forming a flush surface with plane of said front wall of said housing.

15. An appliance stand as claimed in claim 14 wherein all of said housing walls are angled toward said top member to provide inclined side surfaces angled about 14° from vertical.

16. An appliance stand comprising an integrally formed plastic housing with a front wall, side walls connected to said front wall, a rear wall connected to said side walls and a planar top member secured to each of said walls; said walls and top member defining an interior chamber, said front wall defining a rectangular cutout leading into said chamber;

a drawer slide support member mounted to said housing; said drawer slide support member having a plurality of legs, a cross member connecting said legs and a rail mounted on each leg;

a drawer slidably mounted in said housing chamber on said drawer slide member, said drawer comprising an integrally formed assembly comprising a base, a front panel, side panels and a rear panel formed with and connected to said base but defined from said base by a fold groove allowing said panels to be folded at an angle to a plane of said base, said front and rear panels having hinge means which mate with hinge means formed on the inner end surface of the side panels allowing the side panels to be fastened to the front and rear panels.

* * * * *